US012582898B2

(12) United States Patent
Kosanam

(10) Patent No.: US 12,582,898 B2
(45) Date of Patent: Mar. 24, 2026

(54) HANDSFREE DICE ROLLER

(71) Applicant: Nikhil Kosanam, Bethel, CT (US)

(72) Inventor: Nikhil Kosanam, Bethel, CT (US)

( * ) Notice: Subject to any disclaimer, the term of this patent is extended or adjusted under 35 U.S.C. 154(b) by 540 days.

(21) Appl. No.: 18/164,501

(22) Filed: Feb. 3, 2023

(65) Prior Publication Data

US 2024/0261672 A1 Aug. 8, 2024

(51) Int. Cl.
*A63F 9/04* (2006.01)

(52) U.S. Cl.
CPC ..... *A63F 9/0406* (2013.01)

(58) Field of Classification Search
USPC ..... 273/145 R, 145 C, 145 E
See application file for complete search history.

(56) References Cited

U.S. PATENT DOCUMENTS 434,613 A * 8/1890 Turner ..... A63F 9/0406 273/145 C
557,938 A * 4/1896 Averell ..... A63F 9/0406 273/145 A
2,396,475 A * 3/1946 Rodekurt ..... A63F 5/048 273/143 R
2,791,432 A * 5/1957 Alvernaz ..... A63F 9/0406 366/279
3,350,098 A * 10/1967 Cromp ..... A63F 9/0406 200/600
3,360,267 A * 12/1967 Johnson ..... A63F 9/0406 273/145 CA
4,807,883 A * 2/1989 Silverman ..... A63F 9/0415 273/274
2008/0048394 A1* 2/2008 C. H. ..... A63F 9/0406 273/144 R
2022/0203217 A1* 6/2022 Teng ..... A63F 9/0406

* cited by examiner

*Primary Examiner* — Kyle R Grabowski
(74) *Attorney, Agent, or Firm* — Wilmer Cutler Pickering Hale and Dorr LLP

(57) ABSTRACT

A dice rolling apparatus comprising a base, a controller, a sensor, a motor comprising a rotor, a dice enclosure comprising a member, a connecting structure. The member is attached to an inner surface of the shell of the dice enclosure and is positioned in a direction substantially parallel to an axis of rotation of the rotor. The connecting structure connects the rotor to the dice enclosure where the connecting structure extends from the rotor along the axis of rotation of the rotor. The sensor detects a motion proximate from the sensor and sends a triggering signal to the controller, and the controller sends a controlling signal to the motor when receiving the triggering signal from the sensor. The rotor and the dice enclosure rotates when the motor receives the controlling signal, and the dice placed inside the dice enclosure roll by making contact with the member.

19 Claims, 9 Drawing Sheets

HANDSFREE DICE ROLLER

FIELD OF THE INVENTION

The present innovations generally address dice rolling systems. More particularly, the present innovations relate to systems and methods for rolling one or more dice where a person rolling the dice does not have to physically or directly touch the dice.

BACKGROUND

Many board games are commonly played with one or more dice. Rolling the dice is meant to introduce an element of luck to the game. In a typical board game that uses dice, a player picks up the dice with his or her hand, rolls the dice, picks up the dice again, and hands the dice to the next player. The next player then picks up the dice, rolls, and hands the dice to the next player. This conventional way, however, is vulnerable in various aspects. For example, allowing players to possess the dice for a certain amount of time creates an opportunity for a player to gain an advantage over other players, for example, by modifying, swapping, or altering the dice. Also, by rolling the dice too far, even unintentionally, a player may lose the dice or take an unnecessarily longer amount of time in retrieving the dice, delaying gameplay. Moreover, by physically touching and sharing the dice, players may spread infectious diseases to other players. Therefore, a system and method that keeps the dice in one place without having players make physical contact with the dice, yet still allows players to roll the dice, is needed.

SUMMARY

The present disclosure is directed at systems and methods for rolling the dice without touching the dice. In some embodiments, a dice rolling apparatus is provided. The dice rolling apparatus can include a base, a controller, a sensor that is electrically connected to the controller, a motor comprising a rotor and is electrically connected to the controller, a dice enclosure, and a connecting structure that connects the rotor to the dice enclosure. The controller, the sensor and the motor can be attached to the base. A shell of the dice enclosure can be transparent and the dice enclosure can include at least one member inside the dice enclosure. At least one member can be attached to an inner surface of the shell of the dice enclosure and can be positioned in a direction that is substantially parallel to an axis of rotation of the rotor. The member can be located inside the dice enclosure. One end of the connecting structure can be attached to the rotor and another end of the connecting structure can be attached to an outer surface of the shell of the dice enclosure. The connecting structure can extend from the rotor along the axis of rotation of the rotor.

In some embodiments, the sensor can be configured to detect a motion proximate from the sensor and send a triggering signal to the controller upon detecting the motion. The controller can be configured to send a controlling signal to the motor upon receiving the triggering signal from the sensor, and the rotor can be configured to rotate when the motor receives the controlling signal from the controller.

In some embodiments, the rotor can be configured to rotate at least 180 degrees clockwise and/or at least 180 degrees counterclockwise when the motor receives the controlling signal from the controller. In some embodiments, a degree of rotation of the rotor can be adjustable. In some embodiments, a speed of rotation of the rotor can be adjustable. The degree and speed of rotation can be adjusted by the controlling signal. In some embodiments, the motor can be a DC (direct current) motor or a servo motor.

In some embodiments, the dice enclosure can be a sphere. The dice enclosure can also be a cube or a spheroid. The dice enclosure can further include a hinge and a hatch, wherein the hatch can be configured to open and close.

In some embodiments, the connecting structure can have a single contact point between the connecting structure and the dice enclosure. In some embodiments, the single contact point can be positioned along the axis of rotation of the rotor. In other embodiments, the connecting structure can have more than one contact point between the connecting structure and the dice enclosure.

In some embodiments, the sensor can be configured to detect the motion within 2 inches from the sensor. In other embodiments, the detectable range of the sensor can be adjustable.

In some embodiments, at least one of the base, the sensor, the motor, the dice enclosure and the connecting structure can be removably attached from one of the base, the sensor, the motor, the dice enclosure or the connecting structure. In some embodiments, at least one of the base, the sensor, the motor, the dice enclosure and the connecting structure can have interlockable surface.

Additionally, in some embodiments, a method of touchless dice rolling is provided. The method can include detecting, by the sensor, a motion proximate from the sensor, and sending a triggering signal to a controller responsive to the sensor detecting the motion. The method can also include receiving, by the controller, the triggering signal from the sensor, and sending a controlling signal to a motor responsive to the controller receiving the triggering signal. The method can further include receiving, by the motor, the controlling signal from the controller, wherein the motor comprises a rotor. The method can further include rotating the rotor responsive to the motor receiving the controlling signal from the controller, wherein a connecting structure connects the rotor and a dice enclosure.

In some embodiments, the method can include rotating the dice enclosure at least 180 degrees clockwise and/or at least 180 degrees counterclockwise at a certain speed when the motor receives the controlling signal from the controller. The method can also include rolling at least one dice by having the at least one dice make a physical contact with at least one member that can be attached to an inner surface of the shell of the dice enclosure as the dice enclosure rotates. In some embodiments, the degree and speed of rotation of the rotor can be adjusted. In some embodiments, the detectable range of the sensor can be adjusted.

BRIEF DESCRIPTION OF THE DRAWINGS

While multiple embodiments are disclosed, still other embodiments of the present disclosure will become apparent to those skilled in the art from the following detailed description, which shows and describes illustrative embodiments of the disclosure. Accordingly, the drawings and detailed description are to be regarded as illustrative in nature and not restrictive.

DETAILED DESCRIPTION

In the following description, numerous specific details are set forth regarding the structures, systems, and methods of the disclosed subject matter and the environment in which such structures, systems, and methods may operate, etc., in order to provide a thorough understanding of the disclosed subject matter. It will be apparent to one skilled in the art, however, that the disclosed subject matter may be practiced without such specific details, and that certain features, which are well known in the art, are not described in detail in order to avoid complication of the disclosed subject matter. In addition, it will be understood that the examples provided below are exemplary, and that it is contemplated that there are other structures, systems, and methods that are within the scope of the disclosed subject matter.

The present invention is directed to systems and methods for rolling dice without touching the dice. For example, an exemplary apparatus can include a base, a controller, a sensor, a motor, a dice enclosure, and a connecting structure. A player may wave any part of his or her body in proximate distance from the sensor. The sensor can detect the player's motion and send a triggering signal to the controller. The controller can send a controlling signal to the motor and the motor can rotate a rotor. Rotating the rotor can rotate the dice enclosure that is connected to the rotor through the connecting structure, thereby rolling the dice placed inside the dice enclosure.

Figure 1:
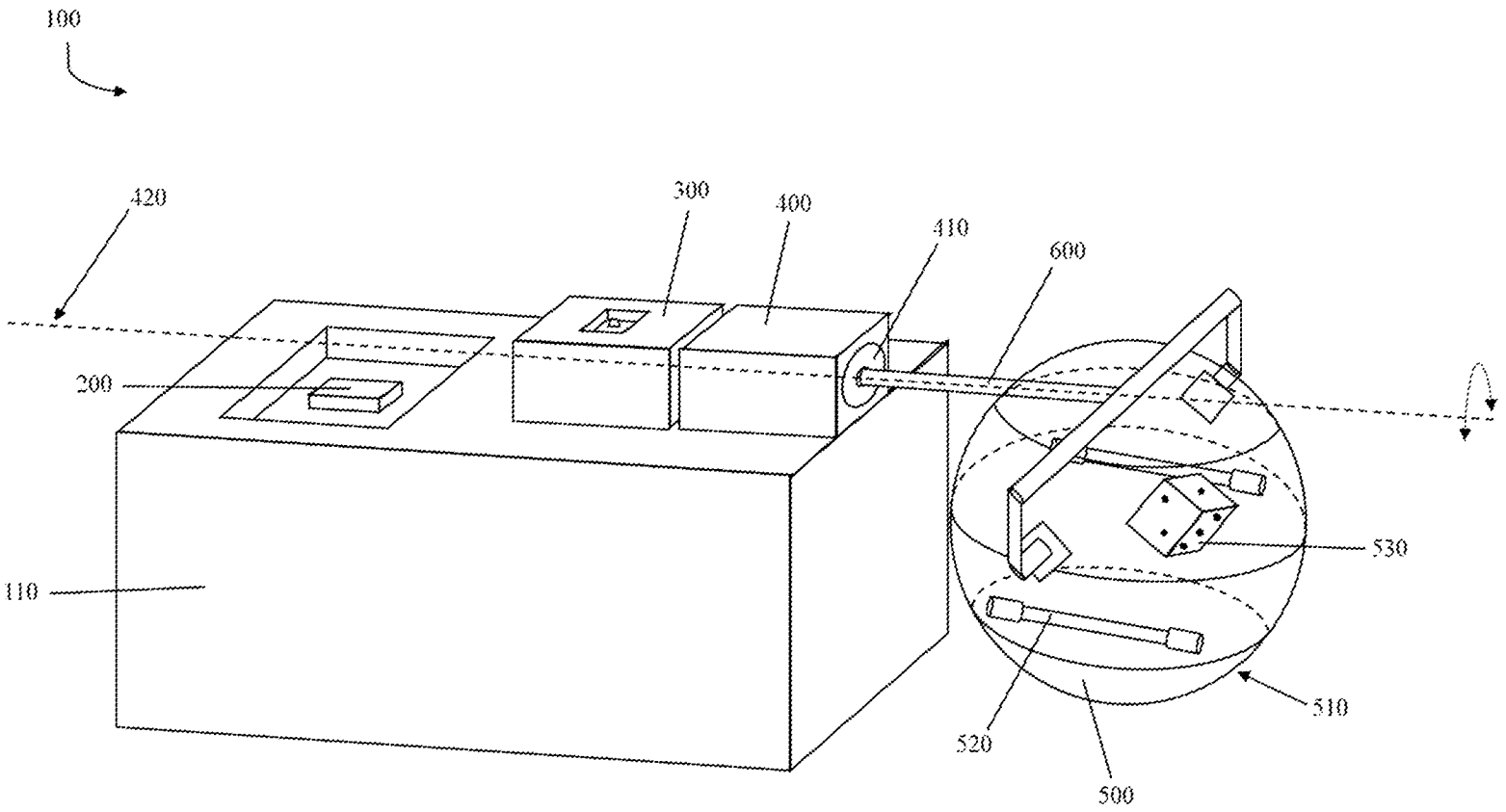
FIG. 1 shows a perspective view of an exemplary dice rolling apparatus, according to some embodiments.

FIG. 1 shows a perspective view of an exemplary dice rolling apparatus 100, according to some embodiments. As shown in FIG. 1, the dice rolling apparatus 100 includes a base 110, a controller 200, a sensor 300, a motor 400 comprising a rotor 410, a dice enclosure 500 and a connecting structure 600. The controller 200, the sensor 300 and the motor 400 can be attached to the base 110 by a fixed mechanical mounting or a detachable connector that allows removable attachment to the base 110. The dice enclosure 500 can include a shell of the dice enclosure 510 and at least one member 520 inside the dice enclosure 500. A one or more dice 530 can be placed inside the dice enclosure 500. The shell of the dice enclosure 510 can be transparent to allow players to see the one or more dice 530 placed inside the dice enclosure 500. The dice enclosure 500 is connected to the rotor 410 through the connecting structure 600. Examples of how the rotor 410, the dice enclosure 500, and the connecting structure 600 can be connected along with embodiments of the connecting structure 600 are further explained in detail according to FIG. 6A and FIG. 6B.

As shown in FIG. 1, the connecting structure 600 can extend from the rotor 410 along the axis of rotation of the rotor 420. For example, the motor 400 comprising the rotor 410 can be placed so that an axis of rotation of the rotor 420 is substantially aligned with a part of the connecting structure 600. As the rotor 410 rotates, the connecting structure 600 attached to the rotor 410 and the dice enclosure 500 attached to the connecting structure 600 can also rotate in the same direction. As the dice enclosure 500 rotates, at least one of the dice 530 can move inside the dice enclosure 500. At least one of the dice 530 while in motion can make contact with at least one of the members 520, and in consequence, at least one of the dice 530 may roll, tilt, or otherwise change its orientation. Without the presence of the member 520, the dice 530 may "slide" instead of "roll" because of the friction between the dice 530 and the shell of the dice enclosure 510. Embodiments of the dice enclosure 500 showing exemplary configurations of the placement of one or members 520 in relation to the dice enclosure 500 is further described in detail according to FIG. 5.

In some embodiments, the controller 200, the sensor 300 and the motor 400 do not all have to be individually or separately attached to the base 110. For example, while the controller 200 and the motor 400 can be attached to the base 110, the sensor 300 can be attached to the motor 400, e.g., the sensor 300 can be stacked on top of the motor 400. In another example, the controller 200 can be attached to the base 110, and the sensor 300 and the motor 400 can be attached to the controller 200, e.g., the sensor 300 and the motor 400 can both be stacked on top of the controller 200. In another embodiment, the base 110 may include one or more of the controller 200, the sensor 300 and the motor 400. That is, one or more of the controller 200, the sensor 300 and the motor 400 can be integrated into the base 110.

Figure 2:
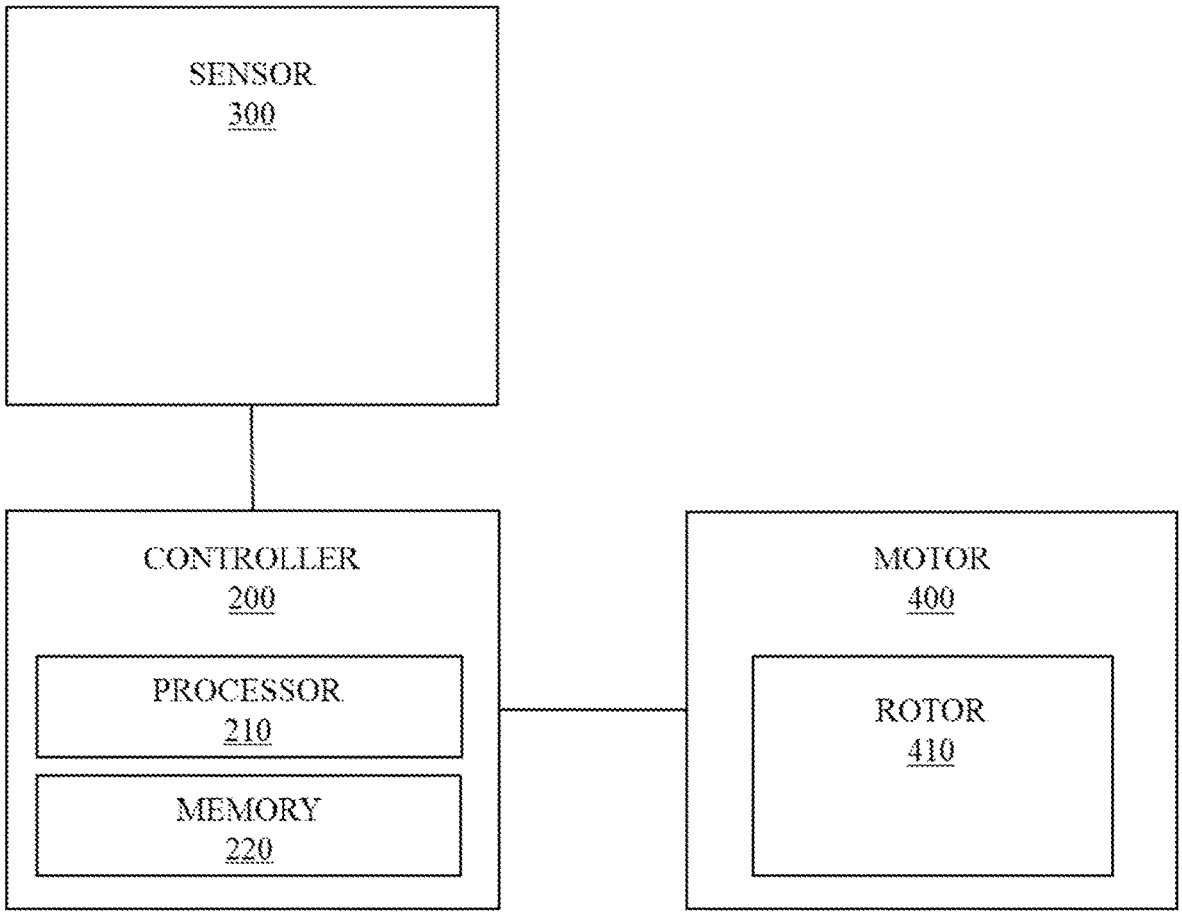
FIG. 2 shows a block diagram of a part of the dice rolling apparatus, according to some embodiments.

FIG. 2 shows a block diagram that schematically illustrates a part of the dice rolling apparatus 100, according to some embodiments. The controller 200 can include a processor 210 and a memory 220. In some embodiments, the processor 210 and the memory 220 can be integrated. Also, in some embodiments, the processor 210 and the memory 220 can be a single component or can include necessary circuits to perform the embodiments described herein. The memory 220 can include one or more different types of memory, such as read-only memory (ROM), random-access memory, cache memory, flash memory devices, optical storage devices, etc. The memory 220 can also include an interface for updating instructions that, when executed by the processor 210, are able to perform the embodiments described herein.

As shown in FIG. 2, the sensor 300 and the motor 400 can be electrically connected to the controller 200. The sensor 300 and the motor 400 include circuits and sub components necessary for performing the embodiments described herein. In some embodiments, the sensor 300 can be configured to detect a motion proximate from the sensor 300 and send a triggering signal to the controller 200 upon detecting the motion. The controller 200 can be configured to send a controlling signal to the motor 400 upon receiving the triggering signal from the sensor 300. The rotor 410 can be configured to rotate when the motor 400 receives the controlling signal from the controller 200.

Figure 3:
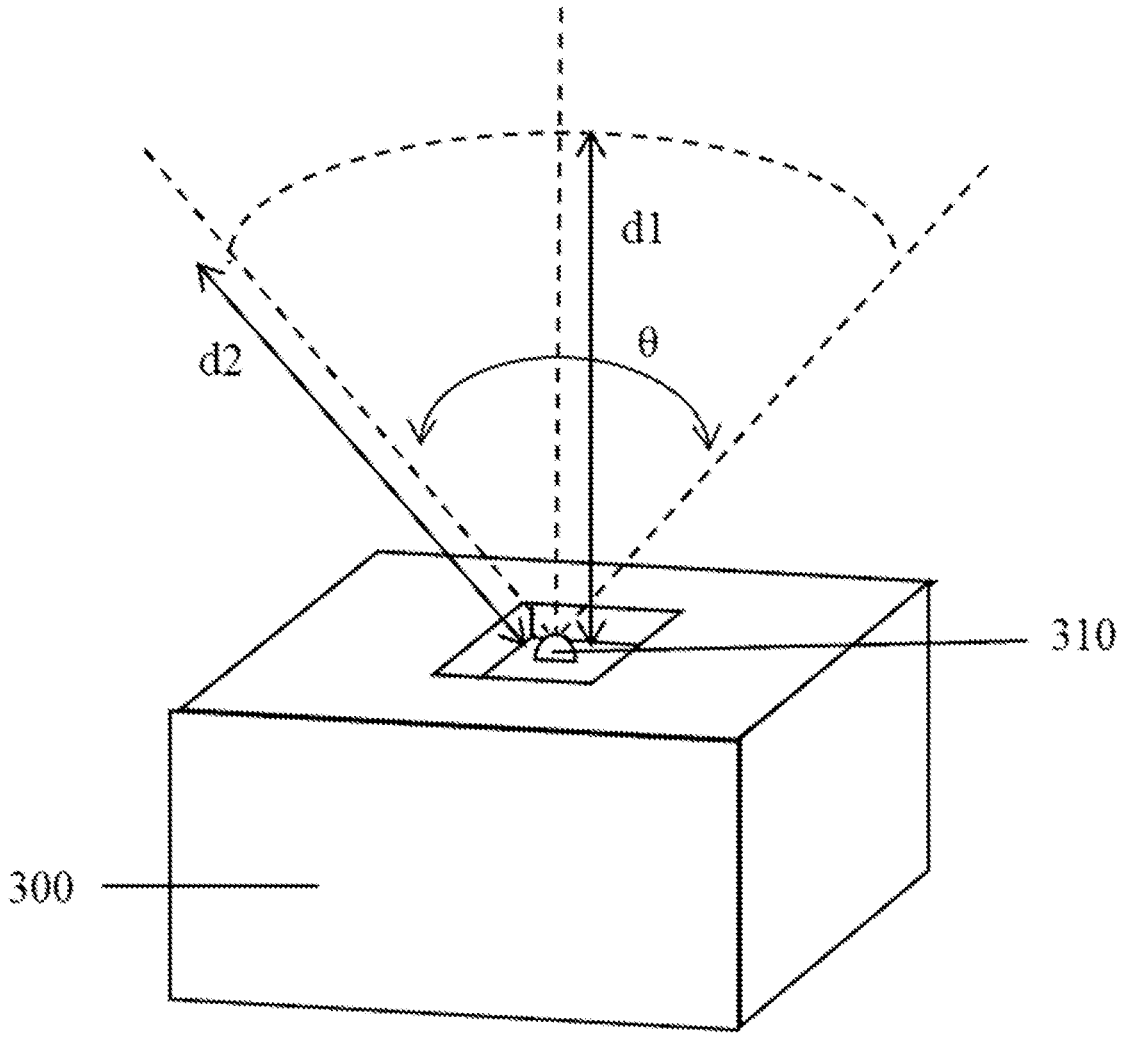
FIG. 3 shows a perspective view of an example sensor, used in some embodiments of the dice rolling apparatus.

FIG. 3 shows a perspective view of an embodiment of the systems disclosed herein showing an example of the sensor 300, according to some embodiments. The sensor 300 can include a sensing node 310. The type and the details of the sensing node will be appreciated by those having ordinary skill in the art. In FIG. 3, the sensing node 310 is shown, facing upward, and placed on the top side of the sensor 300. The location of the sensing node 310 is not limited to the top side of the sensor 300. The shape of the sensor 300 in FIG. 3 is shown as a rectangular cuboid as an example; however, the current invention does not limit the sensor 300 to a specific shape. The sensor 300 can be, for example, a cube, a pyramid, a cylinder, etc. One example of the sensor 300, as shown in FIG. 3, can be a passive infrared (PIR) sensor that detects a movement of heat emitting object such as a human body. In other embodiments, different types of sensors can be used. The appropriate location of the sensing node 310 within the sensor 300 and the shape and type of the sensor 300 will be appreciated by those having ordinary skill in the art.

As shown in FIG. 3, the sensor 300 can be configured to detect a motion proximate from the sensor 300. Specifically, the sensing node 310 detects a motion in the direction the sensing node 310 points to and within a certain detectable angle θ. The sensing distance d1 and d2, measured from the sensing node 310, can be the same or different. The sensing distance d1 and d2 typically has maximum value limited by the sensor 300. The maximum detectable angle θ, the maximum detectable distance d1 and d2 can depend on the type of the sensor 300 and will be appreciated by those having ordinary skill in the art. Regardless of the maximum detectable distance, the sensing distance d1 and d2 can both be configured to 2 inches in some embodiments. In other embodiments, d1 and d2 can be adjusted from the controller 200 disclosed herein. Likewise, the detectable angle θ can also be configured to a certain degree or can be adjusted from the controller 200.

Figure 4:
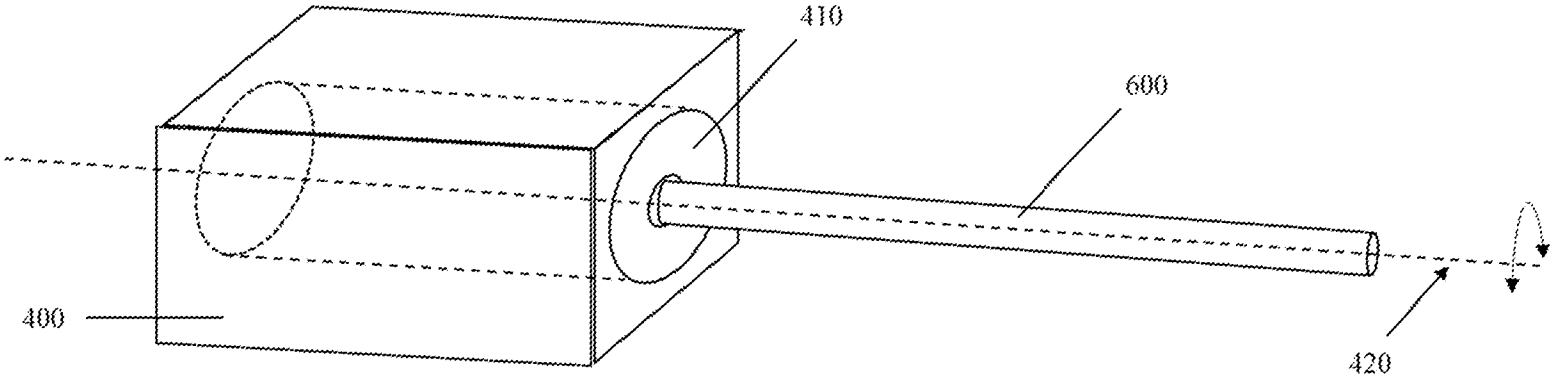
FIG. 4 shows a perspective view of an example motor, used in some embodiments of the dice rolling apparatus.

FIG. 4 shows a perspective view of an embodiment of the systems disclosed herein showing an example of the motor 400, according to some embodiments. The motor 400 can include a rotor 410. In FIG. 4, the rotor 410 is placed approximately at the center of the motor 400 and, as shown, the right side of the rotor 410 is connected to the connecting structure 600. However, the location of the rotor 410 with respect to the motor 400 is not limited to the center of the motor 400. In FIG. 4, the shape of the motor 400 is shown as a rectangular cuboid and the rotor 410 as a cylinder as an example; however, the current invention does not limit the motor 400 or the rotor 410 to a specific shape. The motor 400 or the rotor 410 can be, for example, a cube, a pyramid, a cylinder, etc. One example of the motor 400, as shown in FIG. 4, can be a direct current (DC) motor that can continuously rotate unless it is stopped. In other embodiments, the motor 400 can be a servo motor that rotates only to a directed position. In other embodiments, different types of motors can also be used. The appropriate location of the rotor 410 within the motor 400, the shape and type of the motor 400 and the shape of the rotor 410 will be appreciated by those having ordinary skill in the art.

As shown in FIG. 4, the rotor 410 can be configured to rotate around the axis of rotation 420. The axis of rotation of the rotor 420 can be substantially parallel to one side of the motor 400 and can also be substantially parallel to one side of the base 110. The connecting structure 600 can be attached to the rotor 410 and can extend along the axis of rotation of the rotor 420. In some embodiments, the rotor 410 can be configured to rotate at least 180 degrees clockwise and at least 180 degrees counterclockwise when the motor receives the controlling signal from the controller. In other embodiments, the rotor 410 can be configured to rotate only clockwise or only counterclockwise. In some embodiments, the degree of rotation of the rotor 410 can be adjusted by the controlling signal from the controller 200. Likewise, the speed of rotation can also be adjusted by the controlling signal from the controller 200. In some embodiments, depending on the type of the motor 400, there may be minimum and maximum angle and speed of rotation the rotor 410 can be configured to, which will be appreciated by those having ordinary skill in the art.

Figure 5:
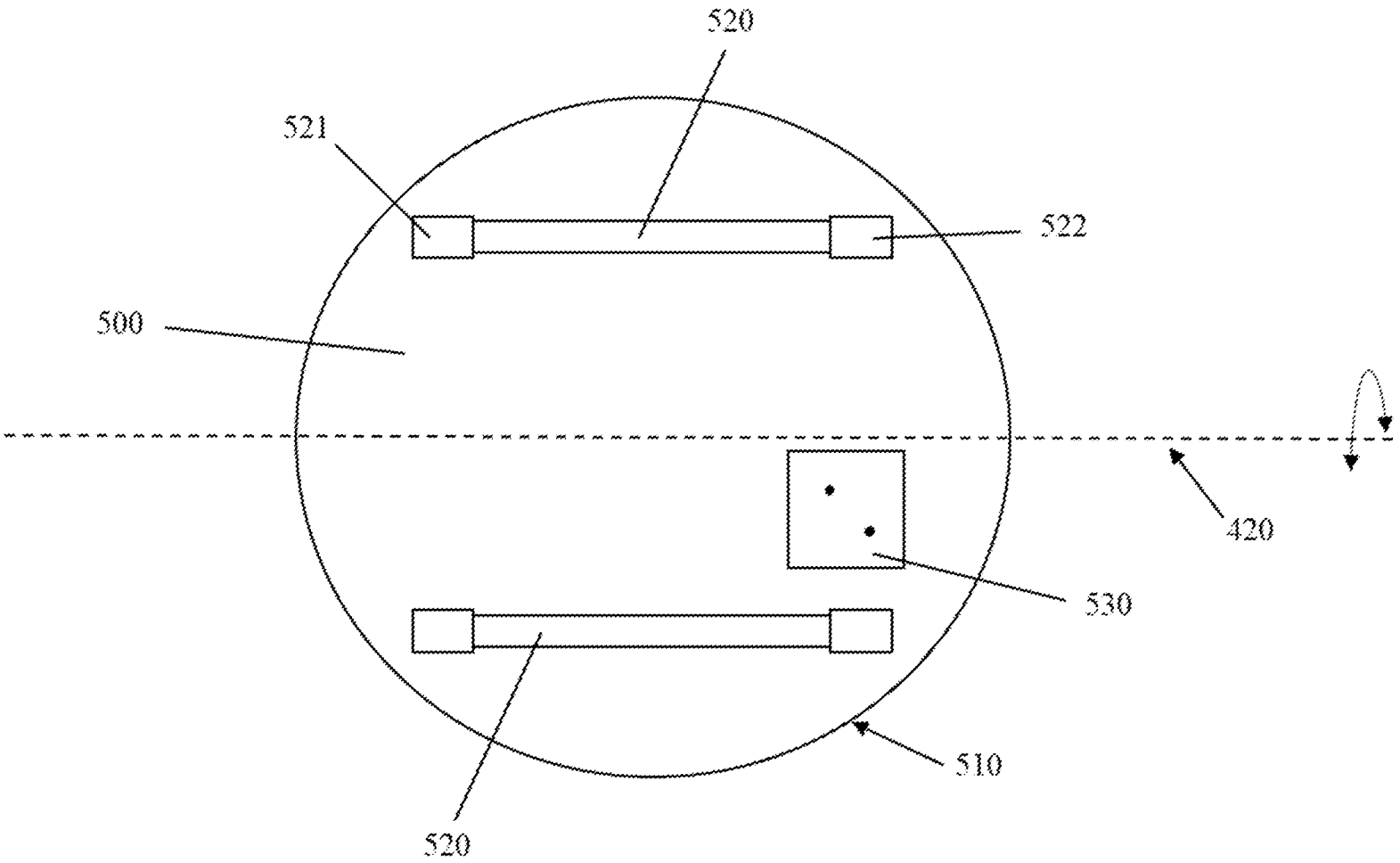
FIG. 5 shows a top view of an example dice enclosure, used in some embodiments of the dice rolling apparatus.
Figure 8:
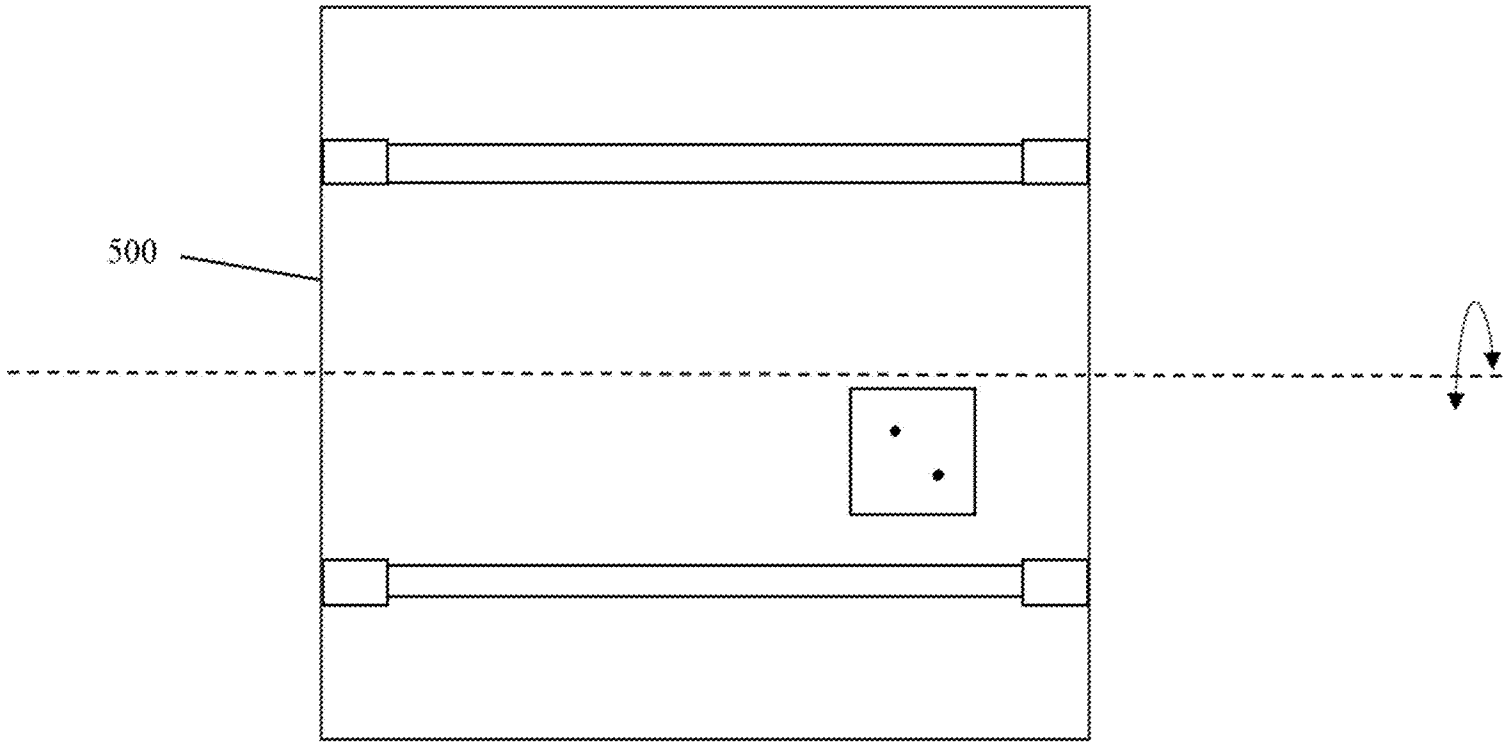
FIG. 8 shows a top view of another example dice enclosure, used in some embodiments of the dice rolling apparatus.

FIG. 5 shows a top view of an embodiment of the systems disclosed herein showing an example of the dice enclosure 500, according to some embodiments. In FIG. 5, the shape of the dice enclosure 500 is shown as a sphere as an example. In some embodiments, the dice enclosure 500 can be of a different shape, such as a cube (as shown in FIG. 8), a spheroid, etc. The dice enclosure 500 can also include a hinge and a hatch mechanism (not shown in FIG. 5), wherein the hatch is configured to open and close, allowing players to open the dice enclosure 500. In other embodiments, the shell of the dice enclosure 510 can be separable into two or more parts to allow players to open the dice enclosure 500. In some embodiments, one or more dice 530 can be placed inside the dice enclosure 500. The shell of the dice enclosure 510 can be transparent, allowing players to see and read the dice 530 from outside the dice enclosure 500 without touching the dice 530 or the dice enclosure 500. The shell of the dice enclosure 510 can also be partially transparent so that players can read the dice 530 through the transparent portion or portions of the shell of the dice enclosure 510, such as one or more windows.

As shown in FIG. 5, in some embodiments, the dice enclosure 500 can include one or more members 520. When the dice enclosure 500 rotates, the dice 530 can move. However, because of the friction between the dice 530 and the shell of the dice enclosure 510, the dice may "slide" along the inner surface of the shell of the dice enclosure 510, and not "roll" in a manner that can change the orientation of the dice. As a result, the dice 530 may stand on the same side multiple times in a row. This outcome can skew the result of the game being played and take away the element of chances that is supposed to be integral to the conventional dice rolling. The member 520 facilitates the dice 530 to "roll" when the dice enclosure 500 rotates around the axis of rotation of the rotor 420. With the member 520, the dice 530 makes contact with one of the members 520 and "rolls" when the dice enclosure 500 rotates, maintaining the integral aspect of the conventional dice rolling.

The member 520 can be formed by a straight bar shape, but is not limited to any particular shape. The member 520 can be placed inside the dice enclosure 500 by attaching the member 520 using member sockets 521 and 522. The attachment between the member 520 and the member sockets 521 or 522 does not have to be permanent, and such non-permanent attaching mechanisms can be appreciated by those having ordinary skill in the art, for example, clips, slide-ins, screws, hinges and hatches, etc. This allows players to reconfigure the number of the members 520 in the dice enclosure 500 by removing or adding one or more of the members 520. In some embodiments, the member sockets 521 and 522 can be attached to the inner surface of the shell of the dice enclosure 510. In other embodiments, the member sockets 521 and 522 can be attached to the outer surface of the shell of the dice enclosure 510, and have the member 520 protrude through the shell of the dice enclosure 510. In such embodiments, the member 520 may be removed or added back without a player opening the dice enclosure 500. The member sockets 521 and 522, as shown in FIG. 5, can be placed so that when the member 520 is placed between the member sockets 521 and 522, the member 520 is aligned substantially parallel to the axis of rotation of the rotor 420. The present invention however does not limit the location of the member sockets 521 and 522 and thus does not limit the placement of the member 520 in relation to the axis of rotation of the rotor 420. For example, the member 520 can be attached to only one of member sockets 521 or 522 such that the member 520 protrudes inward from the shell of the dice enclosure 510.

Figure 6A:
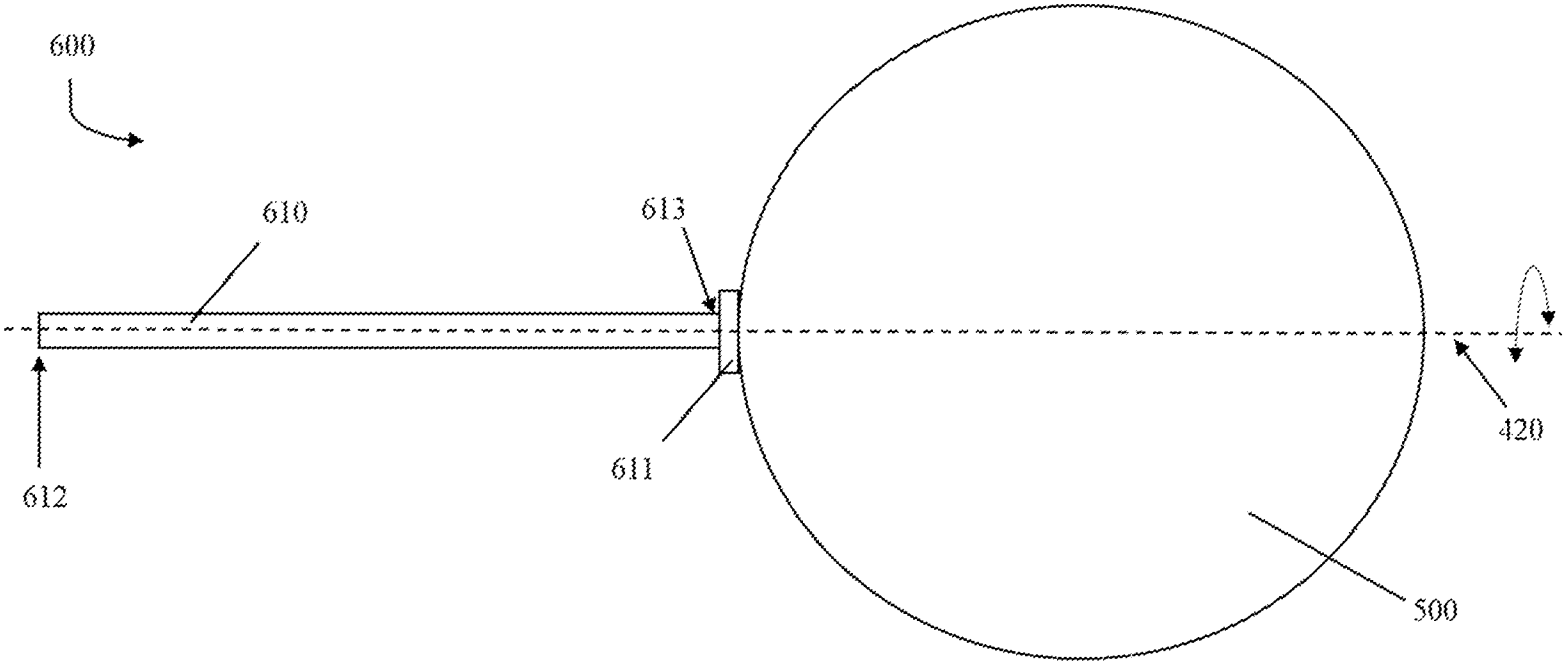
FIG. 6A shows a top view of an example connecting structure, used in some embodiments of the dice rolling apparatus.

FIG. 6A shows a top view of an embodiment of the systems disclosed herein showing an example of the connecting structure 600, according to some embodiments. The connecting structure 600 can include a connecting bar 610 and a dice enclosure attachment 611. A left side of the connecting bar 612 can be connected to the rotor 410 described herein according to some embodiments. A right side of the connecting bar 613 can be connected to the dice enclosure 500, described herein according to some embodiments, via the dice enclosure attachment 611. In this way, one end of the connecting structure 600 (e.g., the left side of the connecting bar 612) can be attached to the rotor 410, and another end of the connecting structure 600 (e.g., the dice enclosure attachment 611) can be attached to the outer surface of the shell of the dice enclosure 510. In such embodiment, the connecting structure can have a single contact point, i.e., the dice enclosure attachment 611, between the connecting structure 600 and the dice enclosure 500. The orientation can change in different embodiments, for example, the rotor 410 can be attached to the right side of the connecting bar 613, and the dice enclosure 500 can be attached to the left side of the connecting bar 612 via the dice enclosure attachment 611. The dice enclosure attachment 611 can be placed along the axis of rotation of the rotor 410, so that the connecting bar 610 is substantially parallel to the axis of rotation of the rotor 420.

Figure 6B:
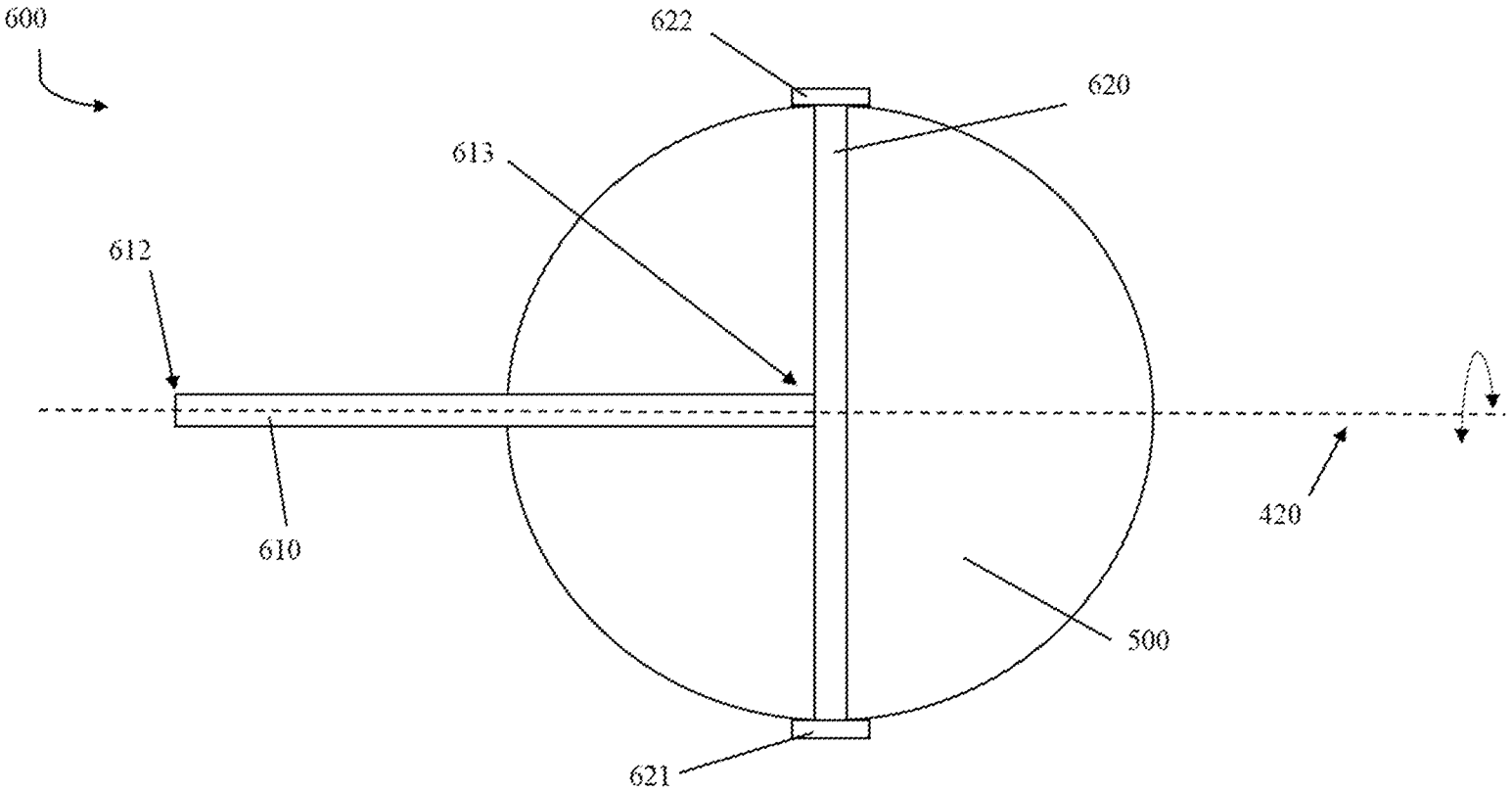
FIG. 6B shows a top view of a second example connecting structure, used in some embodiments of the dice rolling apparatus.

FIG. 6B shows a top view of an embodiment of the systems disclosed herein showing another example of the connecting structure 600 as shown in FIG. 1, according to some embodiments. The connecting structure 600 can include a connecting bar 610, a dice enclosure holding structure 620, and dice enclosure attachments 621 and 622. In this embodiment, the left side of the connecting bar 612 can be connected to the rotor 410 described herein according to some embodiments. The right side of the connecting bar 613 can be connected to the dice enclosure holding structure 620, and the dice enclosure holding structure 620 can be connected to the dice enclosure 500, described herein according to some embodiments, via the dice enclosure attachments 621 and 622. In this way, one end of the connecting structure 600 (e.g., the left side of the connecting bar 612) can be attached to the rotor 410, and another end of the connecting structure 600 (e.g., the dice enclosure attachments 621 and 622) can be attached to the outer surface of the shell of the dice enclosure 510. In such embodiment, the connecting structure can have more than one contact point, i.e., the dice enclosure attachments 621 and 622, between the connecting structure 600 and the dice enclosure 500. The orientation can change in different embodiments, for example, the rotor 410 can be attached to the right side of the connecting bar 613, and the dice enclosure holding structure 620 can be attached to the left side of the connecting bar 612 via the dice enclosure attachments 621 and 622. The dice enclosure attachments 621 and 622 can be placed approximately perpendicular to the axis of rotation of the rotor 420, so that the connecting bar 610 is substantially parallel to the axis of rotation of the rotor 420, as shown in FIG. 6B and FIG. 1.

In some embodiments, at least one of the base 110, the sensor 300, the motor 400, the dice enclosure 500, and the connecting structure 600 can be removably attached from one of the base 110, the sensor 300, the motor 400, the dice enclosure 500 or the connecting structure 600. In some embodiments, at least one of the base 110, the sensor 300, the motor 400, the dice enclosure 500 and the connecting structure 600 can have interlockable surface, so that sub parts can be easily attached and detached from each other.

Figure 7:
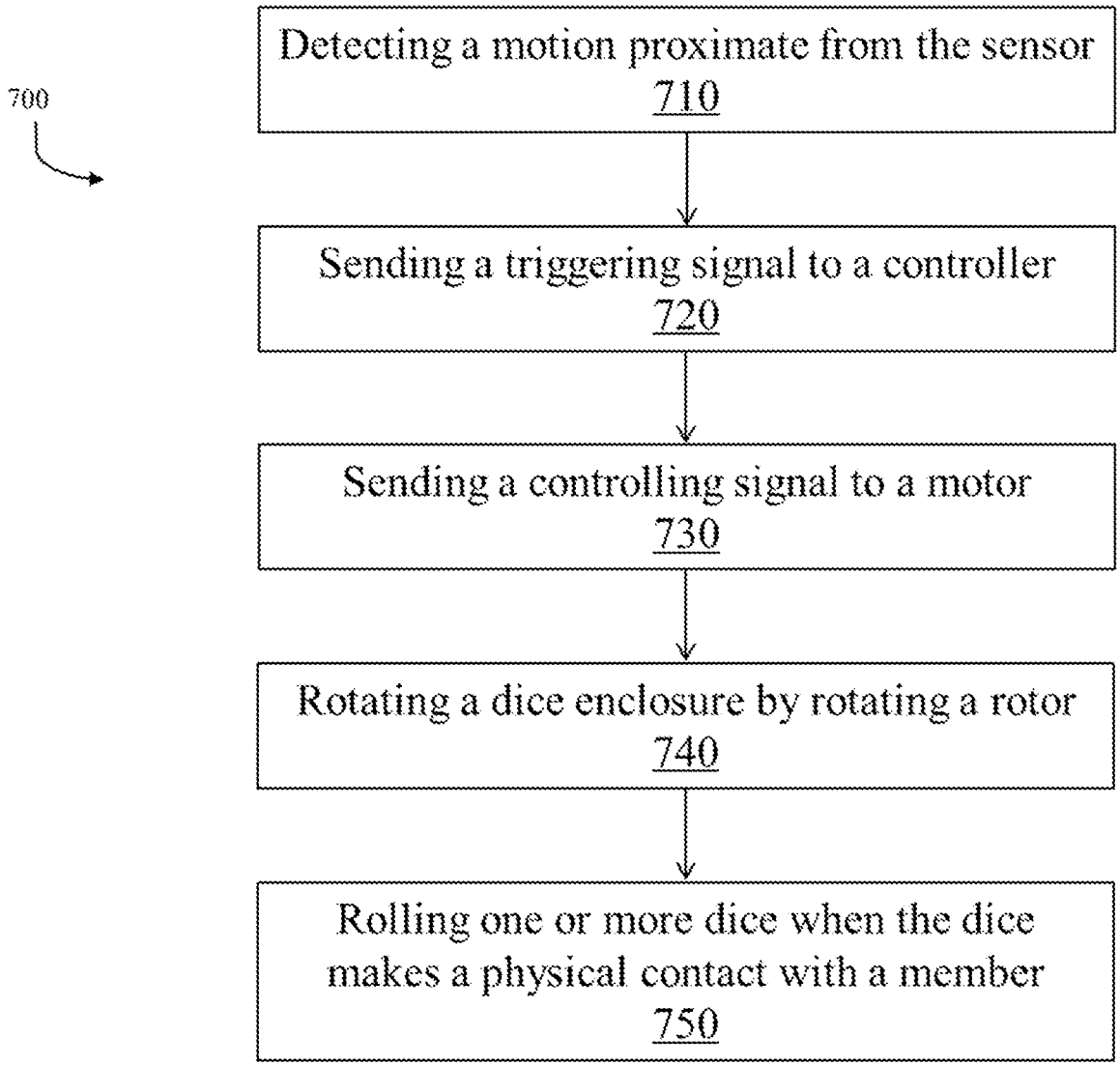
FIG. 7 shows a logic flow diagram that illustrates a method of touchless dice rolling implemented by a dice rolling apparatus, according to some embodiments.

FIG. 7 shows a logic flow diagram that illustrates a method 700 of touchless dice rolling implemented by a dice rolling apparatus, according to some embodiments. The method 700 can include, at step 710, detecting, by the sensor 300, a motion proximate from the sensor 300, and, at step 720, sending a triggering signal to the controller 200 responsive to the sensor 300 detecting the motion. The sensor 300 can be configured by the controller 200 to only send the triggering signal when the motion is within a certain distance from the sensor 300's sensing direction. The sensor 300 can also be configured by the controller 200 to only send the triggering signal when the motion is within a certain angle of the sensor 300's sensing direction. The method can also include receiving, by the controller 200, the triggering signal from the sensor 300, and at step 730, sending a controlling signal to the motor 400 responsive to the controller receiving the triggering signal. The method can further include receiving, by the motor 400, the controlling signal from the controller 200, wherein the motor 400 comprises the rotor 410. The method can further include, at step 740, rotating the rotor 410 responsive to the motor 400 receiving the controlling signal from the controller 200, wherein the connecting structure 600 connects the rotor 410 and the dice enclosure 500. In some embodiments, the method can include rotating the dice enclosure 500 at least 180 degrees clockwise and/or at least 180 degrees counterclockwise at a certain speed when the motor 400 receives the controlling signal from the controller 200. In other embodiments, the method can include rotating the dice enclosure 500 to different degrees or at a different speed, configured by the controlling signal. The method also includes, at step 750, rolling one or more dice 530 by having the one or more dice 530 make a physical contact with one or more member 520 that can be attached to an inner surface of the shell of the dice enclosure 510 as the dice enclosure 500 rotates.

It is to be understood that the disclosed subject matter is not limited in its application to the details of construction and to the arrangements of the components set forth in the description or illustrated in the drawings. The disclosed subject matter is capable of other embodiments and of being practiced and carried out in various ways. Also, it is to be understood that the phraseology and terminology employed herein are for the purpose of description and should not be regarded as limiting.

What is claimed is:

1. A dice rolling apparatus comprising:

a base;

a controller;

a sensor attached to the base, wherein the sensor is electrically connected to the controller;

a motor attached to the base, wherein the motor comprises a rotor and the motor is electrically connected to the controller;

a dice enclosure, wherein a shell of the dice enclosure is transparent, the dice enclosure comprising at least one member inside the dice enclosure, wherein the at least one member is attached to an inner surface of the shell of the dice enclosure, and the at least one member is positioned in a direction substantially parallel to an axis of rotation of the rotor;

a connecting structure that connects the rotor to the dice enclosure, wherein a first end of the connecting structure is attached to the rotor and a second end of the connecting structure is attached to an outer surface of the shell of the dice enclosure, the connecting structure extending from the rotor along the axis of rotation of the rotor;

wherein the sensor is configured to detect a motion proximate from the sensor and send a triggering signal to the controller upon detecting the motion, the controller is configured to send a controlling signal to the motor upon receiving the triggering signal from the sensor, and the rotor is configured to rotate when the motor receives the controlling signal from the controller; and wherein the dice enclosure comprises a hinge and a hatch, the hatch is configured to open and close.

2. The dice rolling apparatus of claim 1, wherein the rotor is configured to rotate at least 180 degrees clockwise and at least 180 degrees counterclockwise when the motor receives the controlling signal from the controller.

3. The dice rolling apparatus of claim 1, wherein a degree of rotation of the rotor is adjustable.

4. The dice rolling apparatus of claim 1, wherein a speed of rotation of the rotor is adjustable.

5. The dice rolling apparatus of claim 1, wherein the motor is a DC motor.

6. The dice rolling apparatus of claim 1, wherein the motor is a servo motor.

7. The dice rolling apparatus of claim 1, wherein the dice enclosure is a sphere.

8. The dice rolling apparatus of claim 1, wherein the dice enclosure is a cube.

9. The dice rolling apparatus of claim 1, wherein the dice enclosure is a spheroid.

10. The dice rolling apparatus of claim 1, wherein the connecting structure has a single contact point between the connecting structure and the dice enclosure, and the single contact point is positioned along the axis of rotation of the rotor.

11. The dice rolling apparatus of claim 1, wherein the connecting structure has more than one contact point between the connecting structure and the dice enclosure.

12. The dice rolling apparatus of claim 1, wherein the sensor is configured to detect the motion within 2 inches from the sensor.

13. The dice rolling apparatus of claim 1, wherein a detectable range of the sensor is adjustable.

14. The dice rolling apparatus of claim 1, wherein at least one of the base, the sensor, the motor, the dice enclosure and the connecting structure are removably attached.

15. The dice rolling apparatus of claim 1, wherein at least one of the base, the sensor, the motor, the dice enclosure and the connecting structure has interlockable surface.

16. A method of touchless dice rolling, the method comprising:

detecting, by a sensor, a motion proximate from the sensor;

sending, from the sensor, a triggering signal to a controller, responsive to the sensor detecting the motion;

receiving, by the controller, the triggering signal from the sensor;

sending, from the controller, a controlling signal to a motor, responsive to the controller receiving the triggering signal;

receiving, by the motor, the controlling signal from the controller, wherein the motor comprises a rotor;

rotating the rotor responsive to the motor receiving the controlling signal from the controller, wherein a connecting structure connects the rotor and a dice enclosure, the dice enclosure comprising a hinge and a hatch, wherein the hatch is configured to open and close;

rotating the dice enclosure at least 180 degrees clockwise and at least 180 degrees counterclockwise; and rolling at least one dice by having the at least one dice make a physical contact with at least one member that is attached to an inner surface of a shell of the dice enclosure as the dice enclosure rotates.

17. The method of claim 16, wherein a degree of rotation of the rotor is adjustable.

18. The method of claim 16, wherein a speed of rotation of the rotor is adjustable.

19. The method of claim 16, wherein a detectable distance of the sensor is adjustable.

* * * * *